United States Patent [19]

Lueken

[11] Patent Number: 4,803,728

[45] Date of Patent: Feb. 7, 1989

[54] STEREO MIXING JACK

[76] Inventor: Jeffrey A. Lueken, 514 Rolling Hills Dr., NW., Bemidji, Minn. 56601

[21] Appl. No.: 65,507

[22] Filed: Jun. 23, 1987

[51] Int. Cl.[4] ..... H04S 1/00

[52] U.S. Cl. ..... 381/25; 439/638; 439/669

[58] Field of Search ..... 439/651, 669, 638, 650, 439/668; 381/1, 25

[56] References Cited

U.S. PATENT DOCUMENTS 3,941,931 3/1976 Osakabe ..... 381/1

4,082,409 4/1978 Bailey et al. ..... 439/668

FOREIGN PATENT DOCUMENTS 2940303 5/1981 Fed. Rep. of Germany ..... 439/669

*Primary Examiner*—Forester W. Isen

*Attorney, Agent, or Firm*—Schroeder & Siegfried

[57] ABSTRACT

An adapter for interfacing between the output of a stereophonic sound source and a standard headphone set to suppress either the lead vocal and instrumental sound signals or in a second embodiment to suppress the left channel of a reproduced sound recording.

2 Claims, 1 Drawing Sheet

STEREO MIXING JACK

DESCRIPTION

BACKGROUND OF THE INVENTION

The present invention relates generally to an audio signal mixing system, and more particularly, to an apparatus which silences various instruments or vocals within an audio signal.

In learning vocal or instrumental music, it is often beneficial to sing or play along with previously recorded music. The desired effect is to replace portions of the pre-recorded audio signal with dubbed-in vocal or instrumental parts. Prior art audio signal mixing systems such as U.S. Pat. No. 3,941,931 to Osakabe require complex circuitry to remove or suppress the specific musical signal.

Another system available from LT Sound, Dept. PS-3, P.O. Box 338, Stone Mountain, Ga. 30086, called "Thompson Vocal Eliminator" claims to remove most or virtually all of the lead music vocal from a standard stereo record while leaving most of the background music untouched. This system appears to be a rather large unit encompassing various electronic circuits to remove only the vocal portion of previously recorded music.

SUMMARY OF THE INVENTION

An apparatus and method for stereo mixing comprises an adapter for interfacing between the stereo output of a standard stereo source and a standard headphone to remove the lead instruments and lead vocals from a pre-recorded stereo sound recording. The adapter contains a male and female portion with the male portion containing two electrically conductive paths and a ground connection. The male portion of the plug communicates with the female portion to provide a first electrical conductive path to both of the left and right stereo input to the headphone set. Meanwhile, the second electrical path of the male plug is provided by the female receptacle to the ground or common connection of the headphone set.

In an alternative embodiment of the present invention, the stereo mixing jack adapter can be employed to remove the left channel of a pre-recorded sound recording thereby allowing the right channel to be heard through both earphones of the headphone set. In this configuration, the first electrical connection from the male plug is routed to its own male plug ground connection and to the female left and right connection for the headphone set. The second electrical connection of the male portion of the adapter is connected to the female portion of the adapter and thereby connects to the ground or common connection of the headphone set.

The present invention provides a simple, inexpensive adapter for the silencing of various instrumental or vocal portions of sound from a stereo sound recording.

DESCRIPTION OF THE PREFERRED EMBODIMENT

Figure 1:
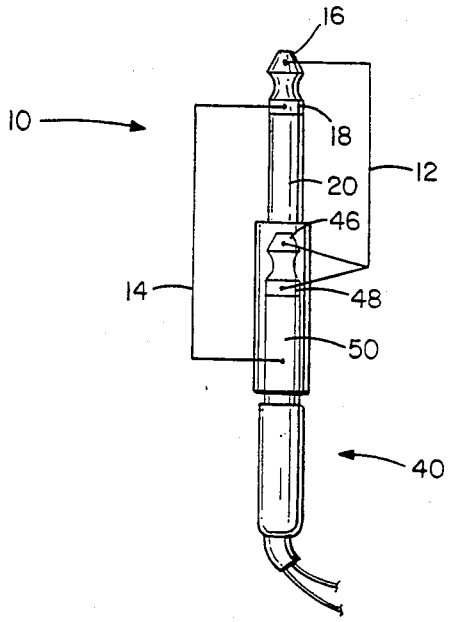
FIG. 1 is a schematic diagram showing an embodiment of the stereo mixing jack according to the present invention.

Shown in FIG. 1 is the stereo mixing jack adapter 10 having connected to it a standard headphone plug 40. The jack is made up a male plug portion and a female receptacle to interface between the output of the stereophonic source in a standard headphone set. The male portion of the jack contains a first and second electrical connections 16 and 18 corresponding to the left and right channels of the stereophonic output. A third electrical connection 20 is a ground or common electrical connection to provide a return electrical path for the left and right channels of the stereo output. In the embodiment shown in FIG. 1, the first electrical path 12 connects to the central contact or first electrical region of the male plug 16 through the female receptacle to both the left and right channels 46 and 48 of the standard headphone set 40. A second electrical path 14 connects the radial contact or second electrical region 18 of the male plug to the ground or common electrical connection 50 of the standard headphone set. The common ground contact 50 is the third electrical region of the headphone set plug.

In this configuration, the stereo mixing jack suppresses the lead instrumental and vocal sound and allows only the rhythm instrumentals and background vocals to be heard.

Construction of the adapter can be of molded plastic having a metal prong. The electrical contacts and wiring can be like those of presently available headphone jacks. Internal wiring can be soldered in place. The adapter unit can be of unitary or multiple piece construction. The adapter can be made in both the $\frac{1}{4}$ inch and $\frac{1}{8}$ inch standard diameter for headphone jacks.

To use the present invention, the stereo mixing jack adapter is inserted into the output jack of a stereophonic source. Then a standard set of headphones is plugged into the adapter. Wearing the headphones provides the background music to which the singer or player can add his own lead vocal or instrument sound. A recording of this would dub the singer or player's music onto the prerecorded background sound. Even without recording his efforts, the adapter permits the singer or player to practice in full accompaniment.

Figure 2:
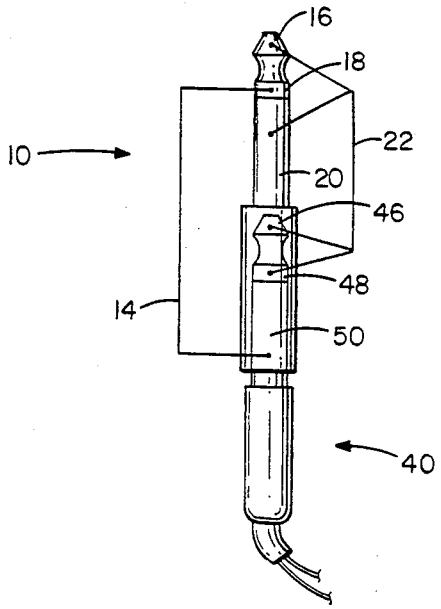
FIG. 2 is a schematic diagram showing another embodiment of the invention.

In an alternative embodiment of the present invention, the stereo mixing jack can be used to silence the left channel allowing the right channel to be heard through both earphones of the headphone set. This configuration is shown in FIG. 2 where a stereo mixing jack adapter 10 has a male plug portion and a female portion to interface between the output of a stereophonic source of a standard headphone set 40. This configuration differs from the first embodiment by electrical connection 22 which connects the central electrical contact 16 and the common ground portion 20 of the male plug via the female receptacle to the left and right channels 46 and 48 of the standard headphone set. A second electrical connection 14 connects the radial electrical contact 18 of the male plug via the female receptacle in the same manner as embodiment No. 1 to the common or ground connection 50 of the standard headphone set.

As presently constructed, two stereo mixing jack adapters are needed. The first configuration as described in embodiment one suppress the lead vocal instrument parts and retain the rhythm instrumentals and background vocals. This allows, for example, one to practice lead guitar or lead vocal in harmony with a pre-recorded sound recording.

The configuration described in embodiment two allows a person to hear the right channel through both earphones of the headphone set.

While it may be possible to combine both embodiments on the stereo mixing jack together on one adapter any modification or variation which could be effected by those skilled in the art without deviating from the spirit and scope of the novel concepts of the present invention are covered by the appended claims.

What is claimed:

1. An apparatus for use between the output of a stereophonic source having a left channel, right channel and common ground outputs, and the input of a headphone set having a standard headphone set plug with corresponding left channel, right channel and common ground inputs, to suppress lead instrumental and vocal audio signals, comprising:

(a) an adapter having a male plug portion and a female receptacle portion;

(b) said male plug portion adapted to mate with the output of the stereophonic source, said male plug portion having first, second, and third electrical conductivity connections corresponding respectively to the left channel, right channel and common ground outputs of the stereophonic source;

(c) said female receptacle portion being adapted to receive the standard headphone set plug, said female portion being in electrical communication with said male plug portion;

(d) said adapter having electrical paths constructed and arranged to electrically connect said male plug portion to the input of the headphone set when the headphone set plug is received by said female receptacle, wherein one said electrical path electrically connects said first conductivity connection of said male plug to the left and right channel inputs of the headphone set; and (e) a second electrical path electrically connects said second conductivity connection of said male plug to the common ground input of the headphone set.

2. An apparatus for use between the output of a stereophonic source having left channel, right channel and common ground outputs, and the input plug of a headphone set having corresponding left channel, right channel and common ground inputs for suppressing the left channel of the stereophonic source so that the right channel is head through both earphones of the headphone set, comprising:

(a) an adaptor having a male plug portion and a female receptacle portion;

(b) said male plug portion being adapted to mate with the output of the stereophonic source, said male plug portion having first, second, and third electrical regions corresponding respectively with the left channel, right channel and common ground outputs of the stereophonic source;

(c) said female receptical portion being adapted to receive the input plug of the headphone set, said female receptacle portion being in electrical communication with said male plug portion of said adaptor;

(d) a first electrical conductivity path constructed and arranged for electrically connecting said first electrical region and said third electrical region of said male plug portion via said female receptacle portion to the left channel and right channel inputs of the input plug of the headphone set; and (e) a second electrical path electrically connecting said second electrical region of said male plug portion to the common ground input of the headphone set.

* * * * *

UNITED STATES PATENT AND TRADEMARK OFFICE

CERTIFICATE OF CORRECTION

PATENT NO. : 4,803,728

DATED : February 7, 1989

INVENTOR(S) : JEFFREY A. LUEKEN

It is certified that error appears in the above-identified patent and that said Letters Patent is hereby corrected as shown below:

Column 4, Claim 2, Line 62, "head" should be --heard--.

Signed and Sealed this

Twenty-fifth Day of July, 1989

*Attest:*

DONALD J. QUIGG

*Attesting Officer*

*Commissioner of Patents and Trademarks*